US012540451B2

(12) United States Patent
Miyazaki et al.

(10) Patent No.: US 12,540,451 B2
(45) Date of Patent: Feb. 3, 2026

(54) TRAJECTORY GENERATION SYSTEM

(71) Applicant: KOBELCO CONSTRUCTION MACHINERY CO., LTD., Hiroshima (JP)

(72) Inventors: Ryunosuke Miyazaki, Hiroshima (JP); Masaki Akiyama, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 153 days.

(21) Appl. No.: 18/693,782

(22) PCT Filed: Mar. 11, 2022

(86) PCT No.: PCT/JP2022/010798
§ 371 (c)(1),
(2) Date: Mar. 20, 2024

(87) PCT Pub. No.: WO2023/053497
PCT Pub. Date: Apr. 6, 2023

(65) Prior Publication Data

US 2024/0384500 A1 Nov. 21, 2024

(30) Foreign Application Priority Data

Sep. 29, 2021 (JP) ..... 2021-159775

(51) Int. Cl.
*E02F 3/43* (2006.01)
*E02F 9/26* (2006.01)

(52) U.S. Cl.
CPC ..... *E02F 3/437* (2013.01); *E02F 9/265* (2013.01)

(58) Field of Classification Search
CPC ..... E02F 3/43; E02F 3/437; E02F 9/265
(Continued)

(56) References Cited

U.S. PATENT DOCUMENTS 6,085,583 A 7/2000 Cannon et al.
10,508,412 B2 * 12/2019 Hashimoto ..... E02F 3/84
(Continued)

FOREIGN PATENT DOCUMENTS

EP 3 748 087 A2 12/2020
EP 3 779 067 A1 2/2021
(Continued)

OTHER PUBLICATIONS

International Search Report mailed on Apr. 19, 2022 in PCT/JP2022/010798 filed on Mar. 11, 2022 (2 pages).

*Primary Examiner* — Andrew Joseph Rudy
(74) *Attorney, Agent, or Firm* — Oblon, McClelland, Maier & Neustadt, L.L.P.

(57) ABSTRACT

A target trajectory of an attachment is corrected while an operation of the attachment is prevented from giving a feeling of anxiety to a worker around a work machine. A target trajectory correcting unit sets a target path of a post-correction target trajectory (TRb) that is obtained by omitting a target point between an omission start point and an omission end point from a plurality of target points on a pre-correction target trajectory. The target trajectory correcting unit sets time information from the omission start point to the omission end point on the post-correction target trajectory TRb based on at least any one of a movement distance and a movement time of a specific portion from the omission start point to the omission end point on the pre-correction target trajectory.

6 Claims, 5 Drawing Sheets

(58) Field of Classification Search
USPC ..... 701/50
See application file for complete search history.

(56) References Cited

U.S. PATENT DOCUMENTS

| | | | | |
|---|---|---|---|---|
| 10,801,187 | B2 * | 10/2020 | Izumi | E02F 9/265 |
| 2019/0218747 | A1 | 7/2019 | Hashimoto | |
| 2024/0026658 | A1 * | 1/2024 | Akiyama | E02F 9/264 |
| 2024/0392532 | A1 * | 11/2024 | Akiyama | E02F 9/20 |

FOREIGN PATENT DOCUMENTS

| | | | |
|---|---|---|---|
| JP | 10-1968 | A | 1/1998 |
| JP | 2000-64359 | A | 2/2000 |
| WO | WO 2018/179383 | A1 | 10/2018 |

* cited by examiner

TRAJECTORY GENERATION SYSTEM

TECHNICAL FIELD

The present invention relates to a trajectory generating system that generates a target trajectory of an attachment of a work machine.

BACKGROUND ART

For example, Patent Literature 1 discloses a technique that corrects a target point (soil release position in Patent Literature 1) of an attachment of a work machine.

CITATION LIST

Patent Literature

Patent Literature 1: JP 2000-64359 A

Patent Literature 1 discloses that a position of one target point among a series of operations of the attachment is corrected. Patent Literature 1, however, does not disclose how a series of operations of the attachment is performed at points other than the target point in a case where the target point is corrected. Therefore, the movement of the attachment after the correction of the target point might give a feeling of anxiety to a worker around the work machine.

SUMMARY OF INVENTION

An object of the present invention is to provide a trajectory generating system that can prevent a movement of an attachment from giving a feeling of anxiety to a worker around a work machine in a case where a target trajectory of the attachment is corrected.

The present invention provides a trajectory generating system that is used in a work machine including a machine body and an attachment. The attachment is mounted on the machine body. The trajectory generating system generates a trajectory of a specific portion of the attachment. The trajectory generating system includes a target trajectory setting unit and a target trajectory correcting unit. The target trajectory setting unit sets a target trajectory including a target path including a plurality of target points and time information that is information about a time for a movement of the specific portion along the target points. The target trajectory correcting unit corrects the target trajectory. The target trajectory correcting unit specifies at least one omission point among the plurality of target points according to a predetermined condition, and sets two points adjacent to both sides of the omission point as an omission start point and an omission end point, respectively. The target trajectory correcting unit sets a corrected target path that is a path from the omission start point to the omission end point so that the omission point for the specific portion is omitted from the plurality of target points on the target trajectory. The target trajectory correcting unit sets the time information about the specific portion from the omission start point to the omission end point in the corrected target path based on at least one of a movement distance and a movement time of the specific portion from the omission start point to the omission end point on a pre-correction target trajectory.

DESCRIPTION OF EMBODIMENTS

Figure 1:
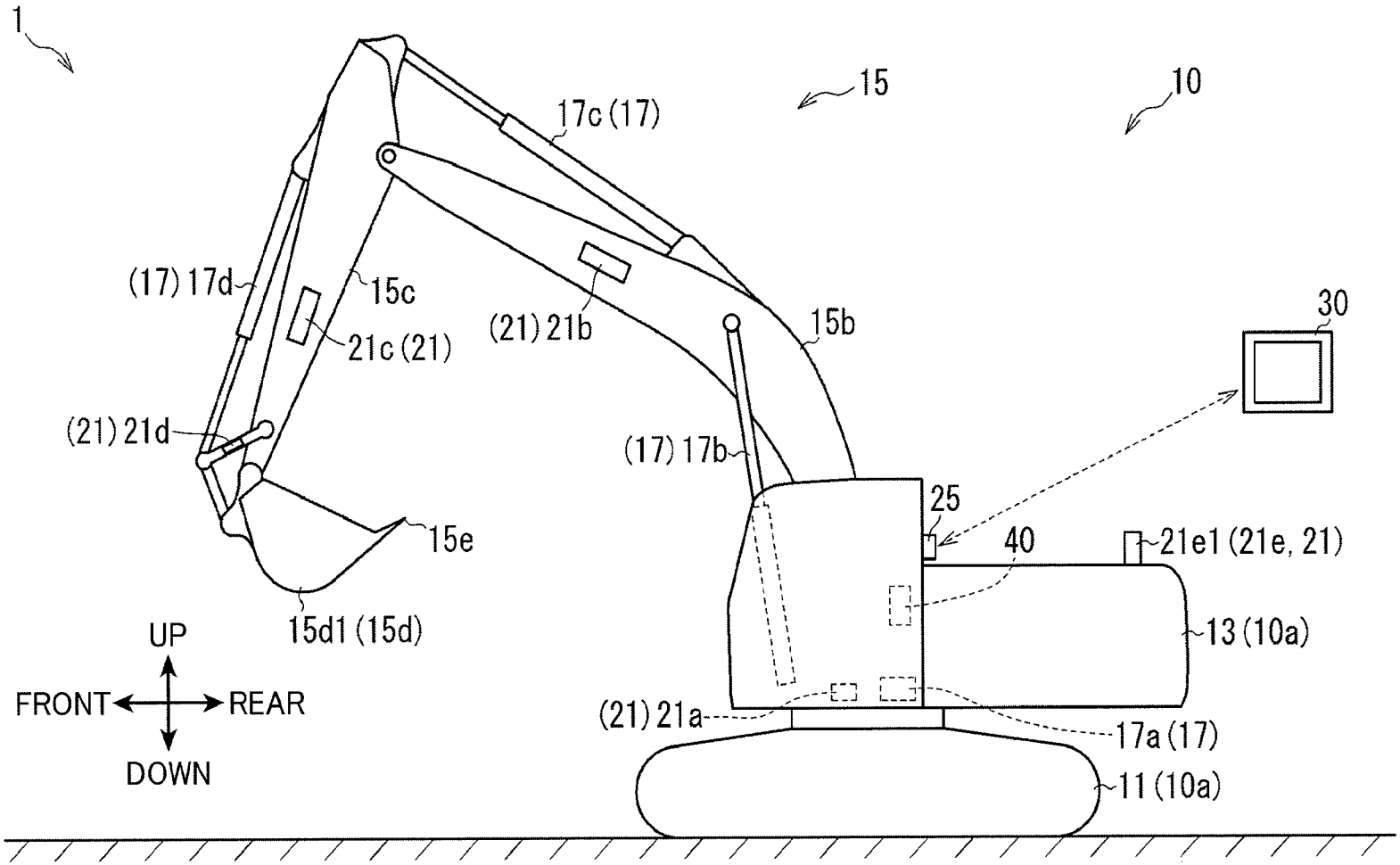
FIG. 1 is a side view of a work machine or the like to which a trajectory generating system according to one embodiment of the present invention is applied.
Figure 2:
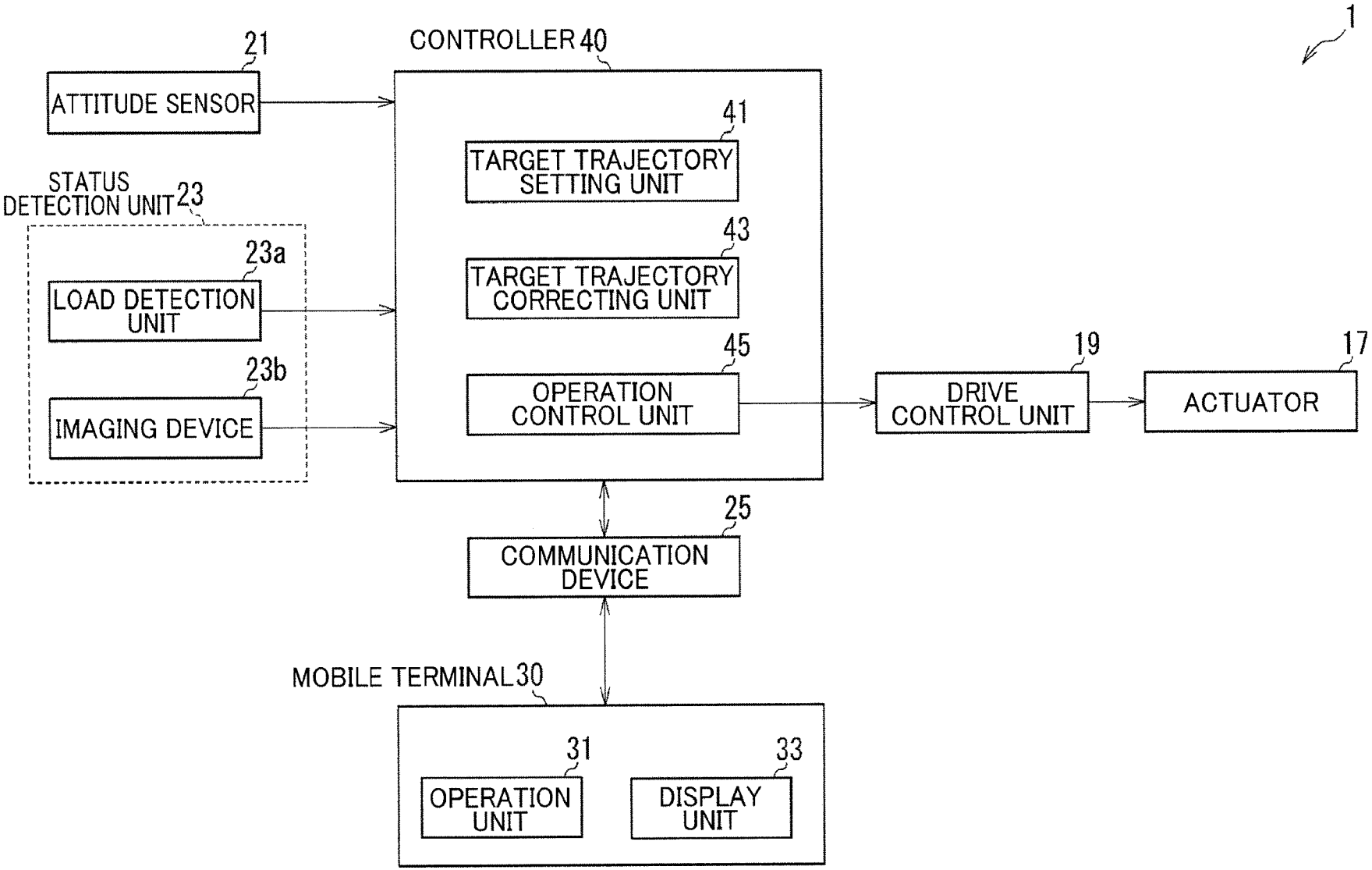
FIG. 2 is a block diagram of the trajectory generating system according to one embodiment of the present invention.
Figure 3:
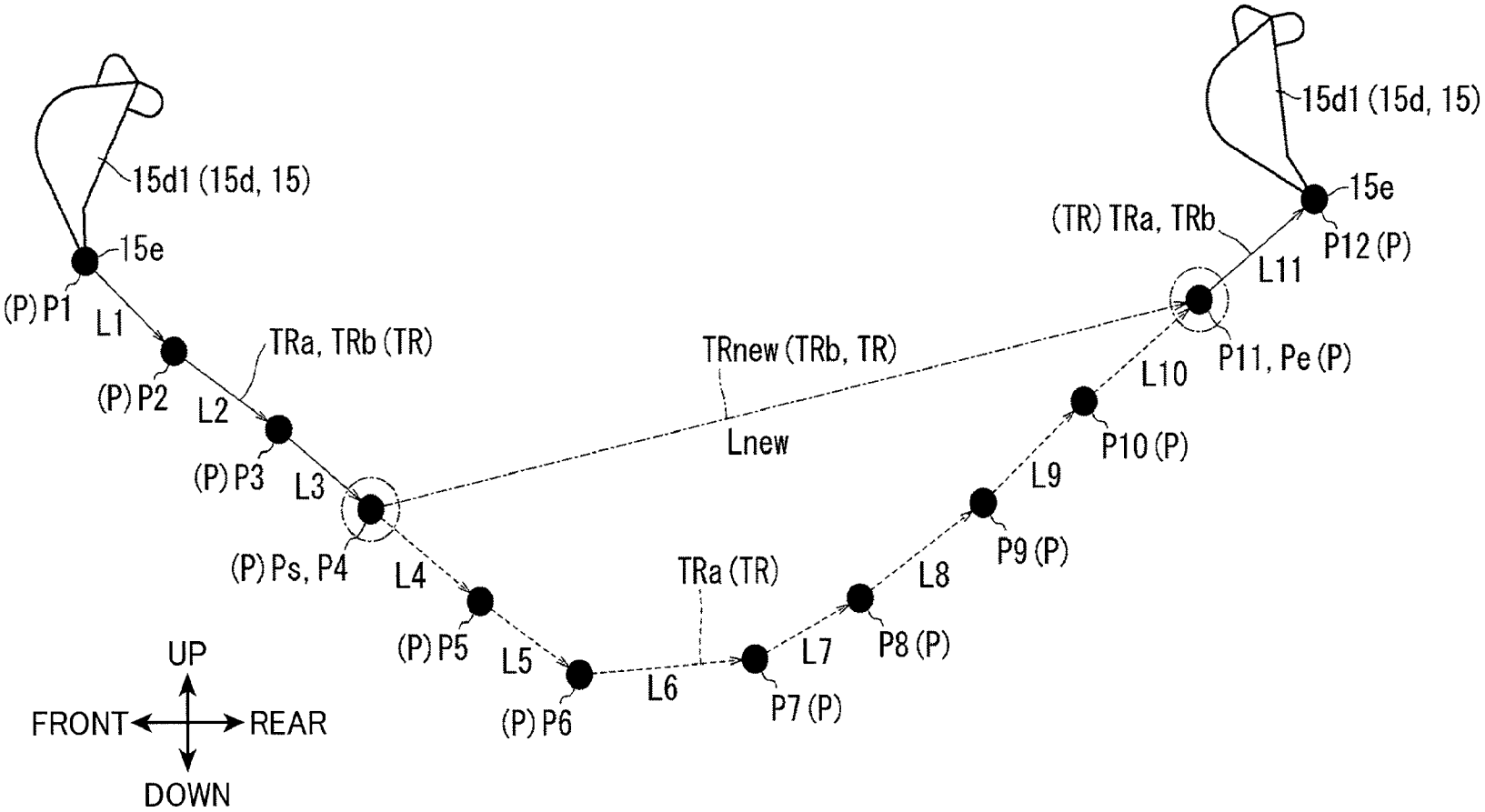
FIG. 3 is a diagram illustrating a target trajectory of a specific portion of an attachment illustrated in FIG. 1.
Figure 4:
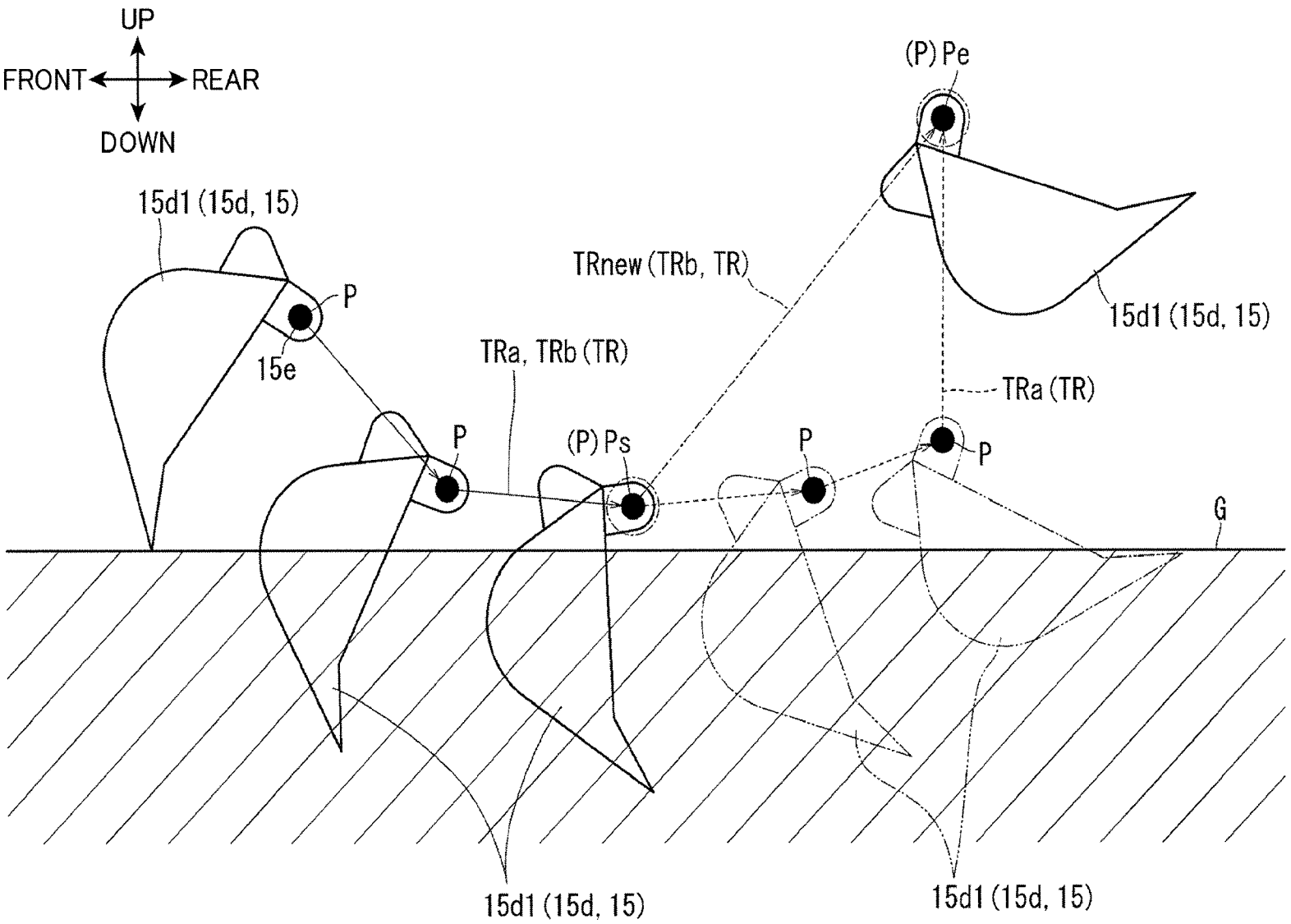
FIG. 4 is a diagram illustrating a target trajectory in a case where a bucket illustrated in FIG. 3 performs excavation.
Figure 5:
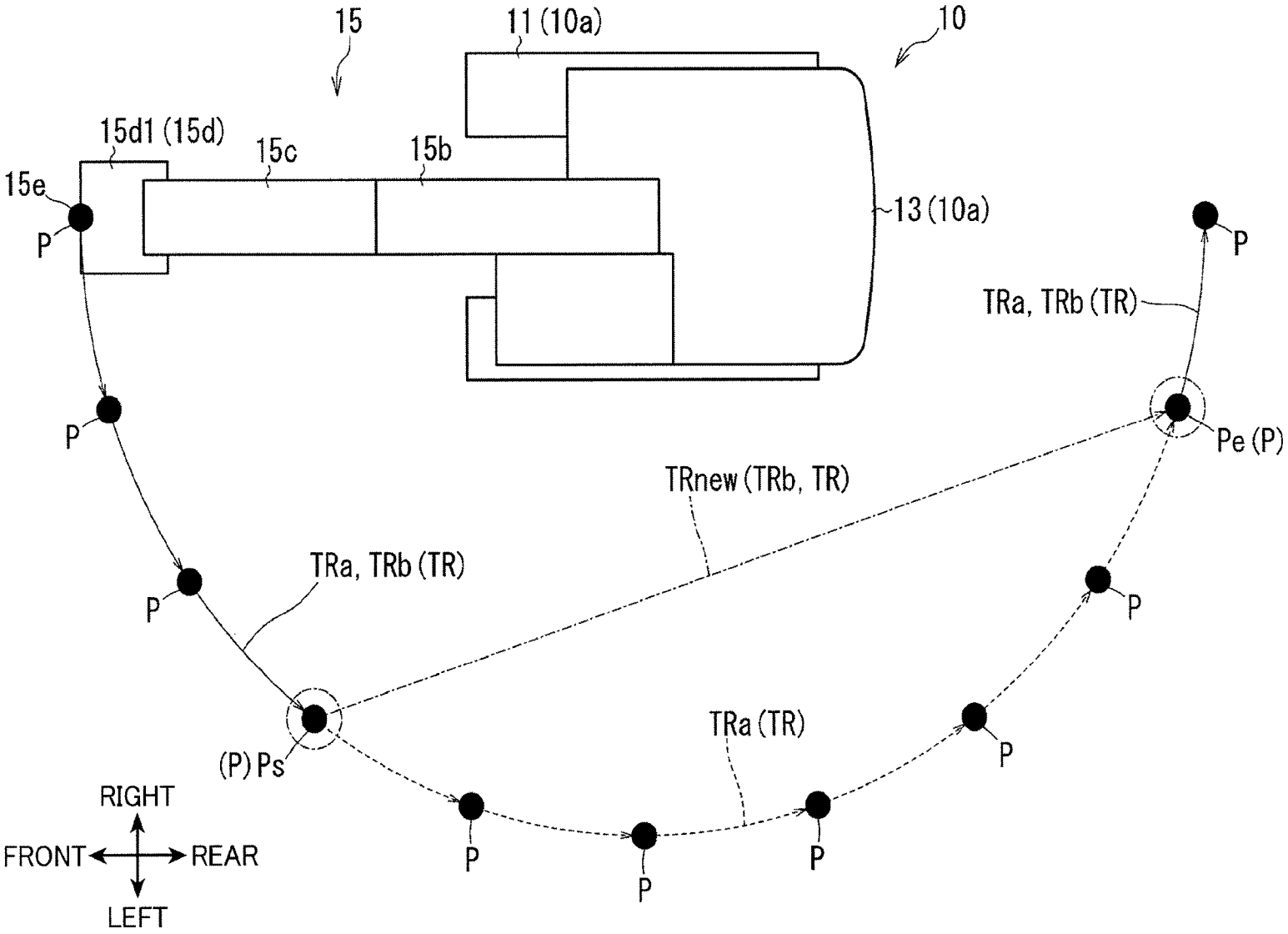
FIG. 5 is a top view of the work machine illustrated in FIG. 1, and is a diagram illustrating a target trajectory of the specific portion during slewing of an upper slewing body.

A trajectory generating system 1 according to one embodiment of the present invention will be described with reference to FIGS. 1 to 5. FIG. 1 is a side view of a work machine 10 or the like to which the trajectory generating system 1 according to the present embodiment is applied. FIG. 2 is a block diagram of the trajectory generating system 1 according to the present embodiment. FIG. 3 is a diagram illustrating a target trajectory TR of a specific portion 15*e* of an attachment 15 illustrated in FIG. 1. FIG. 4 is a diagram illustrating the target trajectory TR in a case where a bucket 15*d*1 illustrated in FIG. 3 performs excavation. FIG. 5 is a top view of the work machine 10 illustrated in FIG. 1, and is a diagram illustrating the target trajectory TR of the specific portion 15*e* during slewing of an upper slewing body 13.

The trajectory generating system 1 is a system that generates a target trajectory TR (see FIG. 3) of a specific portion 15*e* of an attachment 15 of a work machine 10 illustrated in FIG. 1. The trajectory generating system 1 includes an attitude sensor 21, a situation detection unit 23 (see FIG. 2), a communication device 25, a mobile terminal 30, and a controller 40. Note that the trajectory generating system 1 may include the work machine 10.

The work machine 10 is a machine that performs work, for example, a construction machine such as an excavator that performs construction work. The work machine 10 is configured to be automatically driven by the controller 40. The work machine 10 includes a machine body 10*a*, the attachment 15, an actuator 17, and a drive control unit 19 (see FIG. 2).

The machine body 10*a* is a main portion of the work machine 10. The machine body 10*a* includes a lower travelling body 11 and an upper slewing body 13. The lower travelling body 11 causes the work machine 10 to travel. The lower travelling body 11 includes, for example, a crawler. The upper slewing body 13 is mounted on the lower travelling body 11 so as to be able to slew about a slewing center shaft extending in an up-down direction.

The attachment 15 is a portion for performing work, and is attached to the machine body 10*a*(more specifically, the upper slewing body 13). The attachment 15 includes a boom 15*b*, an arm 15*c*, and a distal end attachment 15*d*. The boom 15*b* is mounted on the upper slewing body 13 so as to be raised and lowered (rotatable up and down). The arm 15*c* is rotatably mounted on the boom 15*b*. The distal end attachment 15*d* is provided at a distal end of the attachment 15 and is rotatably attached to the arm 15*c*. The distal end attachment 15*d* may be, for example, a bucket 15*d*1 that excavates (scoops) soil, a device (a grapple or the like) that pinches an object, or a device (a breaker or the like) that crushes or excavates an object. A specific portion of the attachment 15 is defined as the specific portion 15*e*. The specific portion 15*e* is a portion that is moved along the target trajectory TR (see FIG. 3). The specific portion 15*e* is a distal end portion of the distal end attachment 15*d* (more specifically, the bucket 15*d*1) in the example illustrated in FIGS. 1, 3, and 5, and is a proximal end portion of the bucket 15*d*1 (a connection portion between the arm 15*c* and the distal end attachment 15*d* illustrated in FIG. 1) in the example illustrated in FIG. 4.

The actuator 17 moves the work machine 10. The actuator 17 includes a slewing motor 17*a*, a boom cylinder 17*b*, an arm cylinder 17*c*, and a distal end attachment cylinder 17*d*. The slewing motor 17*a* slews the upper slewing body 13 with respect to the lower travelling body 11. The slewing motor 17*a* may be a hydraulic motor or an electric motor. The boom cylinder 17*b* raises and lowers the boom 15*b* with respect to the upper slewing body 13. The boom cylinder 17*b* is, for example, a hydraulic telescopic cylinder (hydraulic cylinder). The same applies to the arm cylinder 17*c* and the distal end attachment cylinder 17*d*. The arm cylinder 17*c* rotates the arm 15*e* with respect to the boom 15*b*. The distal end attachment cylinder 17*d* rotates the distal end attachment 15*d* with respect to the arm 15*c*. Note that, in a case where the distal end attachment 15*d* itself can be driven like, for example, a device that pinches an object, a cylinder or a motor for driving the distal end attachment 15*d* may be provided.

The drive control unit 19 (see FIG. 2) controls the actuator 17. The drive control unit 19 may include a hydraulic circuit or an electric circuit.

The attitude sensor 21 detects an attitude of the work machine 10. The attitude sensor 21 may include a sensor (for example, a rotary encoder) that detects an angle, a sensor that detects an inclination with respect to a horizontal plane, or a sensor that detects a stroke of a hydraulic cylinder that drives the attachment 15. The attitude sensor 21 may detect the attitude of the work machine 10 based on at least one of a two-dimensional image and a distance image. In this case, the two-dimensional image or the distance image may be captured by an imaging device 23*b* (see FIG. 2, described later). The attitude sensor 21 may be mounted on the work machine 10 or may be disposed outside the work machine 10 (for example, at a work site) (the same also applies to the situation detection unit 23, the communication device 25, and the controller 40). For example, the attitude sensor 21 includes a slewing angle sensor 21*a*, a boom angle sensor 21*b*, an arm angle sensor 21*c*, a distal end attachment angle sensor 21*d*, and a reference position sensor 21*e*.

The slewing angle sensor 21*a* detects a slewing angle of the upper slewing body 13 with respect to the lower travelling body 11. The boom angle sensor 21*b* detects a rotation angle of the boom 15*b* with respect to the upper slewing body 13. The arm angle sensor 21*e* detects a rotation angle of the arm 15*c* with respect to the boom 15*b*. The distal end attachment angle sensor 21*d* detects a rotation angle of the distal end attachment 15*d* with respect to the arm 15*c*. The reference position sensor 21*e* detects the position and orientation of the work machine 10 with respect to the work site. The reference position sensor 21*e* may perform detection with a positioning system. The positioning system may be a satellite positioning system, such as, a global navigation satellite system (GNSS). In this case, the reference position sensor 21*e* may include a GNSS antenna 21*e*1 and the like. The positioning system may use a total station.

The situation detection unit 23 (see FIG. 2) (bucket information detection unit) detects a situation (information) of the work machine 10 (bucket 15*d*1). The situation detection unit 23 may detect a situation (machine condition, work condition, etc.) of the work machine 10 itself or may detect a situation around the work machine 10. For example, as illustrated in FIG. 2, the situation detection unit 23 includes a load detection unit 23*a* and an imaging device 23*b*.

The load detection unit 23*a* detects a load acting on the work machine 10 illustrated in FIG. 1. The load detection unit 23*a* (see FIG. 2) may detect a load acting on the attachment 15. The load detection unit 23*a* may detect a load acting on the actuator 17. The load detection unit 23*a* may detect the load acting on the attachment 15 by detecting the load acting on the actuator 17. For example, the load detection unit 23*a* may detect a load acting on the distal end attachment 15*d* (for example, the bucket 15*d*1). For example, the load detection unit 23*a* may detect a load (for example, an oil pressure) acting on the distal end attachment cylinder 17*d* (for example, the bucket cylinder).

The imaging device 23*b* (see FIG. 2) images an imaging object. The "imaging object" may be the work machine 10 or an object around the work machine 10. The imaging device 23*b* may detect two-dimensional information about an imaging object (for example, a position or a shape). The imaging device 23*b* may detect three-dimensional information about an imaging object or may acquire an image (distance image) having distance information (depth information). The imaging device 23*b* may detect three-dimensional information about an imaging object based on the distance image and the two-dimensional image. The imaging device 23*b* may include a camera (monocular camera) that detects two-dimensional information. The imaging device 23*b* may include a device that detects three-dimensional information with laser light, and may include, for example, a light detection and ranging (LIDAR), or, for example, a time of flight (TOF) sensor. The imaging device 23*b* may include a device (for example, a millimeter wave radar) that detects three-dimensional information using radio waves. The imaging device 23*b* may include a stereo camera. Specifically, for example, the imaging device 23*b* may detect the soil volume in the bucket 15*d*1 in a case where the distal end attachment 15*d* is the bucket 15*d*1.

The communication device 25 performs communication. For example, the communication device 25 may perform communication between the controller 40 and the mobile terminal 30. For example, the communication device 25 may perform communication between the controllers 40 disposed outside and inside the work machine 10. Communication by the communication device 25 may include at least one of wireless communication, wired communication, and optical communication.

The mobile terminal 30 is a device (computer) used by a worker. The mobile terminal 30 may be, for example, a tablet or a smartphone. As illustrated in FIG. 2, the mobile terminal 30 includes an operation unit 31 and a display unit 33.

The operation unit 31 is operated by a worker. For example, in the operation unit 31, an operation for performing a setting related to an automatic operation of the work machine 10 (see FIG. 1) may be performed. In the operation unit 31, an operation for instructing setting or correction of the target trajectory TR (see FIG. 3, described later) may be performed.

The display unit 33 performs display. The display unit 33 displays information about the target trajectory TR (see FIG. 3). For example, the display unit 33 performs display related to a post-correction target trajectory TRb (see FIG. 3) (described later). Note that the device provided with the display unit 33 (for example, the mobile terminal 30) and the device provided with the operation unit 31 may be integrated or separated.

The controller 40 is a computer that inputs and outputs signals, performs arithmetic (processing), stores information, and the like. For example, the function of the controller 40 is implemented by causing an arithmetic unit to execute a program stored in a storage unit of the controller 40. For example, the controller 40 acquires information about the attitude of the work machine 10 (see FIG. 1) detected by the attitude sensor 21. For example, the controller 40 causes the drive control unit 19 to automatically operate the work machine 10. The controller 40 sets and corrects the target trajectory TR (see FIG. 3). Note that the controller 40 may be provided separately from the mobile terminal 30 or may be provided in the mobile terminal 30. The controller 40 includes a target trajectory setting unit 41, a target trajectory correcting unit 43, and an operation control unit 45.

The target trajectory setting unit 41 sets the target trajectory TR illustrated in FIG. 3. As will be described later, the target trajectory TR is corrected as necessary, and the target trajectory setting unit 41 (see FIG. 2) sets a pre-correction target trajectory TRa that is a pre-correction target trajectory TR. The target trajectory TR is trajectory to be a target for the specific portion 15*e*. More specifically, an order set of the plurality of target points P (for example, three-dimensional coordinates) of the specific portion 15*e* of the attachment 15 is referred to as a "target path". In the example illustrated in FIG. 3, each position and order from the target point P1 to the target point P12 correspond to the target path. The target path to which a time parameter is added is referred to as the target trajectory TR. This "time parameter" is, specifically for example, a movement time ("a point-to-point time") of the specific portion 15*e* between the two target points P in consecutive order. In other words, the time parameter is information (time information or time-of-day information) about the time for a movement of the specific portion 15*e* along the target points P.

The target trajectory setting unit 41 (see FIG. 2) may set the pre-correction target trajectory TRa based on teaching, or may set the pre-correction target trajectory TRa based on a method other than teaching (for example, input of coordinates by the operation unit 31 (see FIG. 2)). The "teaching" is performed as follows. A worker (operator) gets aboard the work machine 10 illustrated in FIG. 1 to operate the work machine 10, or the worker remotely operates the work machine 10. Then, the worker operates the work machine 10 to move the specific portion 15*e* at such a speed that a time parameter desired to be set as the target trajectory TR is set along the target path desired to be set as the target trajectory TR illustrated in FIG. 3. The target trajectory setting unit 41 (see FIG. 2) then sets the trajectory along which the specific portion 15*e* has moved, as the pre-correction target trajectory TRa. The pre-correction target trajectory TRa including the target path and the time information is stored in the controller 40.

The target trajectory correcting unit 43 (see FIG. 2) corrects the pre-correction target trajectory TRa. The target trajectory correcting unit 43 sets the post-correction target trajectory TRb obtained by omitting some of the target points P on the pre-correction target trajectory TRa (details will be described later).

The operation control unit 45 (see FIG. 2) automatically operates the work machine 10 (see FIG. 1). The operation control unit 45 (see FIG. 2) controls the work machine 10 so that the specific portion 15*e* of the attachment 15 moves along the target trajectory TR. More specifically, the operation control unit 45 (see FIG. 2) controls the work machine 10 (see FIG. 1) so that the specific portion 15*e* moves in accordance with the target path (coordinates and order of each target point P) set as the target trajectory TR and the time parameter (for example, a movement time between the target points P. The operation control unit 45 (see FIG. 2) controls the operation (attitude) of the work machine 10 by inputting a command signal to the drive control unit 19 (see FIG. 2).

<Timing of Correcting Target Trajectory TR>

The target trajectory correcting unit 43 illustrated in FIG. 2 may correct the target trajectory TR (see FIG. 3) based on a determination of the controller 40 (automatically). For example, the target trajectory correcting unit 43 may correct the target trajectory TR based on a detection result of the situation detection unit 23, the detection result being input to the controller 40. More specifically, the target trajectory correcting unit 43 may correct the target trajectory TR (see FIG. 3) based on at least one of the situation of the work machine 10 (see FIG. 1) itself and the situation around the work machine 10 (a specific example will be described later). The target trajectory correcting unit 43 may correct the target trajectory TR when a command (input) of a unit other than the controller 40 is present. For example, the target trajectory correcting unit 43 may correct the target trajectory TR in accordance with a manual operation of the operation unit 31 (for example, tablet operation or the like) by a worker.

<Correction Content of Target Trajectory TR>

The outline of the correction of the target trajectory TR (more specifically, the pre-correction target trajectory TRa) illustrated in FIG. 3 by the target trajectory correcting unit 43 is as follows. Hereinafter, the target trajectory correcting unit 43 will be described with reference to FIGS. 2 and 3. The target trajectory correcting unit 43 sets the target path of the post-correction target trajectory TRb, the target path being obtained by omitting some of the plurality of target points P on the pre-correction target trajectory TRa illustrated in FIG. 3. The target trajectory correcting unit 43 then determines the time parameter of the post-correction target trajectory TRb based on the information about the pre-correction target trajectory TRa (in consideration of the pre-correction target trajectory TRa). Details of the correction of the target trajectory TR by the target trajectory correcting unit 43 are as follows.

<Setting of Target Path>

The target trajectory correcting unit 43 sets two points (two different points) of the plurality of target points P on the pre-correction target trajectory TRa as an omission start point Ps and an omission end point Pe. The order of the omission end point Pe is later than the order of the omission start point Ps. The target trajectory correcting unit 43 sets the post-correction target trajectory TRb formed by omitting target points P (the target points P5 to P10 in the example illustrated in FIG. 3) between the omission start point Ps and the omission end point Pe from the plurality of target points P on the pre-correction target trajectory TRa. Note that how to determine the omission start point Ps and the omission end point Pe will be described later.

<Setting of Time Parameter>

The target trajectory correcting unit 43 sets the post-correction target trajectory TRb so that a worker feels the speeds identical to each other when the specific portion 15*e* moves along the pre-correction target trajectory TRa and when the specific portion 15*e* moves along the post-correction target trajectory TRb. As a result, when the specific portion 15*e* moves along the post-correction target trajectory TRb, a feeling of anxiety (uncomfortable feeling) can be prevented from being given to the worker. For example, when the specific portion 15*e* moves along the post-correction target trajectory TRb, an abrupt movement of the attachment 15 can be prevented.

Specifically, the target trajectory correcting unit 43 sets the post-correction target trajectory TRb from the omission start point Ps to the omission end point Pe based on at least one of a movement distance and a movement time of the specific portion 15*e* from the omission start point Ps to the omission end point Pe on the pre-correction target trajectory TRa. More specifically, the target trajectory correcting unit 43 sets the post-correction target trajectory TRb (hereinafter, also referred to as post-omission target trajectory TRnew) from the omission start point Ps to the omission end point Pe as in the following setting examples 1 and 2.

Setting Example 1

The target trajectory correcting unit 43 may set the post-omission target trajectory TRnew (post-correction target trajectory TRb) so that the movement times of the specific portion 15*e* from the omission start point Ps to the omission end point Pe become equal to each other before and after correction. In this case, the target trajectory correcting unit 43 sets the post-omission target trajectory TRnew so that a post-correction movement time Tnew described below becomes equal to a pre-correction movement time T. The post-correction movement time Tnew is a movement time of the specific portion 15*e* from the omission start point Ps to the omission end point Pe on the post-correction target trajectory TRb (that is, on the post-omission target trajectory TRnew). The pre-correction movement time T is a movement time of the specific portion 15*e* from the omission start point Ps to the omission end point Pe on the pre-correction target trajectory TRa. In this case, since the pre-correction movement time T and the post-correction movement time Tnew are equal to each other, the speeds felt by a worker when the specific portion 15*e* moves from the omission start point Ps to the omission end point Pe are equivalent to each other before and after correction. Therefore, a feeling of anxiety can be prevented from being given to a worker who views the specific portion 15*e* that moves along the post-correction target trajectory TRb.

For example, in the example illustrated in FIG. 3, the target point P4 is the omission start point Ps, and the target point P11 is the omission end point Pe. In this example, the pre-correction movement time T is assumed to be 7 seconds. At this time, the target trajectory correcting unit 43 sets the post-omission target trajectory TRnew so that the post-correction movement time Tnew becomes 7 seconds.

Setting Example 2

The target trajectory correcting unit 43 may set the post-omission target trajectory TRnew so that average speeds of the specific portion 15*e* (average values of movement speeds) from the omission start point Ps to the omission end point Pe become equal to each other before and after correction. In this case, the target trajectory correcting unit 43 sets the post-omission target trajectory TRnew so that a post-correction average speed Vnew described below becomes equal to a pre-correction average speed V. The pre-correction average speed V is an average speed of the specific portion 15*e* from the omission start point Ps to the omission end point Pe on the pre-correction target trajectory TRa. The post-correction average speed Vnew is an average speed of the specific portion 15*e* from the omission start point Ps to the omission end point Pe on the post-correction target trajectory TRb (that is, on the post-omission target trajectory TRnew). In this case, since the pre-correction average speed V and the post-correction average speed Vnew are equal to each other, the speeds felt by a worker when the specific portion 15*e* moves from the omission start point Ps to the omission end point Pe are equivalent to each other before and after correction. Therefore, a feeling of anxiety can be prevented from being given to a worker who views the specific portion 15*e* that moves along the post-correction target trajectory TRb. Further, the time during which the specific portion 15*e* moves from the omission start point Ps to the omission end point Pe is shorter after correction than before correction. Therefore, the attachment 15 can be efficiently moved, and the work efficiency by the attachment 15 is improved.

In the example illustrated in FIG. 3, the pre-correction movement time T is assumed to be 7 seconds. Further, a movement distance along the target path from the target point P4 to the target point P11 on the pre-correction target trajectory TRa is defined as L (L4+L5+ . . . +L9+L10 illustrated in FIG. 3). At this time, the pre-correction average speed V is expressed by an equation, V=L/T. When T is 7 seconds, V=L/7. In addition, a movement distance (linear distance) from the target point P4 to the target point P11 (that is, the post-omission target trajectory TRnew) on the post-correction target trajectory TRb is defined as Lnew. At this time, the post-correction average speed Vnew is expressed by an equation, Vnew=Lnew/Tnew. Since the post-correction average speed Vnew is equal to the pre-correction average speed V (L/T=Lnew/Tnew), the post-correction movement time Tnew is expressed by an equation, Tnew=T×Lnew/L. When T is 7 seconds, Tnew=7×Lnew/L.

Note that the post-correction target trajectory TRb can variously be set by the target trajectory correcting unit 43. For example, the target trajectory correcting unit 43 may set the post-correction target trajectory TRb based on both the pre-correction movement time T and the pre-correction average speed V. The target trajectory correcting unit 43 may set the post-correction target trajectory TRb based on a value obtained by performing at least one of addition, subtraction, multiplication, and division of a correction value with respect to the pre-correction movement time T and the pre-correction average speed V.

<Specific Example of Setting Omission Start Point Ps and Omission End Point Pe>

The target trajectory correcting unit 43 sets the omission start point Ps and the omission end point Pe as follows, for example.

Setting Example 3

The target trajectory correcting unit 43 may set at least any one of the omission start point Ps and the omission end point Pe based on the situation (machine situation, work situation, etc.) of the work machine 10 (see FIG. 1), the situation being detected by the situation detection unit 23 (see FIG. 2). Specific examples in this case are as follows.

<Specific Example of Setting Example 3: Omission of Excavation Operation>

For example, as illustrated in FIG. 4, some of the target points P on the pre-correction target trajectory TRa during the operation for excavating soil (excavation operation) by the bucket 15*d*1 may be omitted.

<Example of Setting Omission Start Point Ps>

The target trajectory correcting unit 43 may set a position of the specific portion 15*e* at a time when the soil volume in the bucket 15*d*1 exceeds a predetermined soil volume threshold (condition A), as the omission start point Ps. The target trajectory correcting unit 43 may set a position of the specific portion 15*e* at a time when a load acting on the bucket 15*d*1 exceeds a predetermined load threshold (condition B), as the omission start point Ps. By setting the position of the specific portion 15*e* at a time when the condition A is satisfied, as the omission start point Ps, the bucket 15*d*1 can be prevented from excavating soil excessively and the efficiency of the excavation operation can be improved (the same applies to the condition B). In a case where the bucket 15*d*1 excavates soil excessively, soil does not enter the bucket 15*d*1 even if the bucket 15*d*1 performs the excavation operation, and the excavation operation may be useless. Further, in the case where the bucket 15*d*1 excavates soil excessively, soil falls out of the bucket 15*d*1, and thus the excavation operation may be useless. The soil volume in the bucket 15*d*1 and the load acting on the bucket 15*d*1 are detected by the situation detection unit 23 described above (see FIG. 2). The situation detection unit 23 may detect only one of the soil volume in the bucket 15*d*1 and the load acting on the bucket 15*d*1. In the example illustrated in FIG. 4, the specific portion 15*e* is a proximal end portion of the bucket 15*d*1.

<Example of Setting Omission End Point Pe>

The target trajectory correcting unit 43 sets an end point of the excavation operation by the bucket 15*d*1 as the omission end point Pe. This excavation operation includes an operation such that the bucket 15*d*1 rotates toward the upper slewing body 13 (excavation side) with respect to the arm 15*c* (see FIG. 1) while the distal end portion of the bucket 15*d*1 moves into the ground (lower side with respect to the ground surface G) and toward the upper slewing body 13 (see FIG. 1). In addition, this excavation operation may include an operation such that the bucket 15*d*1 that has excavated soil moves (lifts) above the ground surface G at an attitude (angle) where soil can be held. The end point of such a series of the excavation operations of the bucket 15*d*1 is set as the omission end point Pe. The next operation after the end of the excavation operation by the bucket 15*d*1 is, for example, an operation (lifting and slewing) including slewing of the upper slewing body 13 (see FIG. 1). Note that a point before the end point of a series of the excavation operations of the bucket 15*d*1 may be set as the omission end point Pe.

Setting Example 4

The target trajectory correcting unit 43 may set at least one of the omission start point Ps and the omission end point Pe based on the situation around the work machine 10 (see FIG. 1), the situation being detected by the situation detection unit 23 (see FIG. 2). Specific examples in this case are as follows.

<Specific Example of Setting 4: Omission of Slewing Operation>

For example, as illustrated in FIG. 5, some of the target points P on the pre-correction target trajectory TRa at a time when the upper slewing body 13 slews (slewing operation) with respect to the lower travelling body 11 may be omitted. The target trajectory correcting unit 43 omits the path of the pre-correction target trajectory TRa, and sets the post-correction target trajectory TRb so that the specific portion 15*e* passes through the path shorter than that before correction (so as not to detour). In this example, the target trajectory correcting unit 43 sets the omission start point Ps and the omission end point Pe as follows.

For example, it is assumed that the attachment 15 enters an entry prohibition area when the specific portion 15*e* moves along the pre-correction target trajectory TRa. In this case, the target trajectory correcting unit 43 sets the omission start point Ps and the omission end point Pe so that the attachment 15 does not enter the entry prohibition area. The "entry prohibition area" is, for example, an area where an obstacle (topography, a vehicle such as a dump car, or the like) exists.

Setting Example 5

The target trajectory correcting unit 43 may set at least any one of the omission start point Ps and the omission end point Pe based on information specified by the operation unit 31 (see FIG. 2). More specifically, a worker specifies the target point P desired to be set as the omission start point Ps from the target points P on the pre-correction target trajectory TRa using the operation unit 31. The target trajectory correcting unit 43 may set the target point P specified by the operation unit 31 as the omission start point Ps. The same applies to the omission end point Pe. Further, in another embodiment, a worker may specify target points P (in FIG. 5, five target points P) (omission points) desired to be omitted from the plurality of target points P on the pre-correction target trajectory TRa, and set the omission start point Ps and the omission end point Pe based on the omission points.

<Display>

The display unit 33 (see FIG. 2) displays information about the post-correction target trajectory TRb set by the target trajectory correcting unit 43. Specifically for example, the display unit 33 may display a figure representing the post-correction target trajectory TRb (for example, see FIGS. 3 to 5). The display unit 33 may display a moving image showing how the attachment 15 including the specific portion 15*e* moves along the post-correction target trajectory TRb.

As illustrated in FIG. 1, the trajectory generating system 1 is used in the work machine 10 having the machine body 10*a* and the attachment 15, and includes the target trajectory setting unit 41 (see FIG. 2) and the target trajectory correcting unit 43 (see FIG. 2). The attachment 15 is mounted on the machine body 10*a* and performs work. The target trajectory setting unit 41 (see FIG. 2) sets the pre-correction target trajectory TRa (see FIG. 3) that is a target trajectory for the specific portion 15*e* of the attachment 15. The target trajectory TR includes a target path including a plurality of target points P and time information that is information about a time for a movement of the specific portion 15*e* along the plurality of target points P. The target trajectory correcting unit 43 (see FIG. 2) corrects the pre-correction target trajectory TRa (see FIG. 3).

The target trajectory correcting unit 43 (see FIG. 2) sets two of the plurality of target points P on the pre-correction target trajectory TRa illustrated in FIG. 3, as the omission start point Ps and the omission end point Pe. In other words, the target trajectory correcting unit 43 specifies at least one omission point among the plurality of target points P according to a predetermined condition, and sets two points adjacent to both sides of the omission point as the omission start point Ps and the omission end point Pe, respectively. The target trajectory correcting unit 43 (see FIG. 2) then sets the post-correction target trajectory TRb formed by omitting the target points P between the omission start point Ps and the omission end point Pe from the plurality of target points P on the pre-correction target trajectory TRa. In other words, the target trajectory correcting unit 43 sets the corrected target path that is the path from the omission start point Ps to the omission end point Pe so that the omission points for the specific portion 15*e* are omitted from the plurality of target points P on the pre-correction target trajectory TRa. Further, the target trajectory correcting unit 43 sets the time parameter (time information) of the specific portion 15*e* from the omission start point Ps to the omission end point Pe on the post-correction target trajectory TRb based on at least any one of the movement distance and the movement time of the specific portion 15*e* from the omission start point Ps to the omission end point Pe on the pre-correction target trajectory TRa.

The above configuration can provide the following effects. The post-correction target trajectory TRb (post-omission target trajectory TRnew) from the omission start point Ps to the omission end point Pe is set in consideration of at least one of the movement distance and the movement time of the specific portion 15*e* from the omission start point Ps to the omission end point Pe on the pre-correction target trajectory TRa. Therefore, the following effects can be obtained as compared with a case where neither the movement distance nor the movement time of the specific portion 15*e* from the omission start point Ps to the omission end point Pe on the pre-correction target trajectory TRa is considered. The post-correction target trajectory TRb can be set so that the movement of the specific portion 15*e* moving along the post-correction target trajectory TRb is close to the movement of the specific portion 15*e* moving along the pre-correction target trajectory TRa. Therefore, the post-correction target trajectory TRb can be set so that the speeds felt by a worker during the movement of the specific portion 15*e* from the omission start point Ps to the omission end point Pe become equivalent to each other before and after correction of the target trajectory TR. As a result, the trajectory generating system 1 (see FIG. 1) can prevent the movement of the attachment 15 from giving a feeling of anxiety to a worker around the work machine 10 in a case where the target trajectory TR of the attachment 15 is corrected.

The target trajectory correcting unit 43 (see FIG. 2) sets the post-correction target trajectory TRb (particularly, the time parameter) illustrated in FIG. 3 so that the following post-correction movement time Tnew becomes equal to the pre-correction movement time T. The post-correction movement time Tnew is a movement time of the specific portion 15*e* (on the post-omission target trajectory TRnew) from the omission start point Ps to the omission end point Pe on the post-correction target trajectory TRb (corrected target path). The pre-correction movement time T is a movement time of the specific portion 15*e* from the omission start point Ps to the omission end point Pe on the pre-correction target trajectory TRa.

With the above configuration, the speeds felt by a worker during the movement of the specific portion 15*e* from the omission start point Ps to the omission end point Pe can be made equivalent to each other before and after correction of the target trajectory TR. Therefore, the trajectory generating system 1 illustrated in FIG. 1 can prevent a sense of anxiety from being given to a worker around the work machine 10.

The target trajectory correcting unit 43 (see FIG. 2) sets the post-correction target trajectory TRb illustrated in FIG. 3 so that the post-correction average speed Vnew described below becomes equal to the pre-correction average speed V. The post-correction average speed Vnew is an average speed of the specific portion 15*e* from the omission start point Ps to the omission end point Pe on the post-correction target trajectory TRb (on the post-omission target trajectory TRnew). The pre-correction average speed V is an average speed of the specific portion 15*e* from the omission start point Ps to the omission end point Pe on the pre-correction target trajectory TRa.

With the above configuration, the speeds felt by a worker during the movement of the specific portion 15*e* from the omission start point Ps to the omission end point Pe can be made equivalent to each other before and after correction of the target trajectory TR. Therefore, the trajectory generating system 1 illustrated in FIG. 1 can prevent a sense of anxiety from being given to a worker around the work machine 10. Further, in this case, the movement time of the specific portion 15*e* from the omission start point Ps to the omission end point Pe illustrated in FIG. 3 can be made shorter on the post-correction target trajectory TRb than on the pre-correction target trajectory TRa. Therefore, since the specific portion 15*e* (the attachment 15) can be efficiently moved, the work efficiency by the attachment 15 can be improved.

The work machine 10 includes the bucket 15*d*1 illustrated in FIG. 4, and the trajectory generating system 1 (see FIG. 1) includes the situation detection unit 23 (bucket information detection unit) (see FIG. 2). The bucket 15*d*1 constitutes the attachment 15 and excavates soil. The situation detection unit 23 (see FIG. 2) detects the situation (information) of the bucket 15*d*1.

The target trajectory correcting unit 43 (see FIG. 2) sets the position of the specific portion 15*e* at a time when at least one of the following [Condition A] and [Condition B] is satisfied, as the omission start point Ps. [Condition A] The situation detection unit 23 (see FIG. 2) detects that the soil volume in the bucket 15*d*1 exceeds a predetermined soil volume threshold. [Condition B] The situation detection unit 23 (see FIG. 2) detects that the load acting on the bucket 15*d*1 exceeds a predetermined load threshold.

In other words, the target trajectory correcting unit 43 may set the omission point based on the position of the specific portion 15*e* at a time when at least one of [condition A] and [condition B] is satisfied.

With the above configuration, the bucket 15*d*1 can be prevented from excavating soil excessively. Note that the above configuration includes that the situation detection unit 23 detects only one of the soil volume in the bucket 15*d*1 and the load acting on the bucket 15*d*1, and the target trajectory correcting unit 43 determines only one of [Condition A] and [Condition B].

As illustrated in FIG. 2, the trajectory generating system 1 includes the display unit 33 that displays the information about the post-correction target trajectory TRb (see FIG. 3) set by the target trajectory correcting unit 43.

With the above configuration, a worker can be notified of the information about the post-correction target trajectory TRb by causing the display unit 33 (see FIG. 2) to display the information without actually moving the specific portion 15*e* along the post-correction target trajectory TRb illustrated in FIG. 3.

MODIFICATIONS

The above embodiment may be variously modified. For example, the connection of the components illustrated in FIG. 2 or the like may be changed. For example, values such as the thresholds (for example, the soil volume threshold and the load threshold) may be constant, may be changed by manual operation, or may be automatically changed in accordance with a certain condition. For example, the number of components may be changed, and some of the components do not have to be provided. For example, the components may be fixed or connected directly or indirectly. For example, a plurality of components and parts different from each other may be described as one component and part. For example, what has been described as one component and part may be divided and provided as a plurality of different components and parts. For example, the components each may have only some of features (function, arrangement, shape, operation, and the like).

The present invention provides a trajectory generating system that is used in a work machine including a machine body and an attachment that is attached to the machine body and performs work, and generates a trajectory of a specific portion of the attachment. The trajectory generating system includes a target trajectory setting unit that sets a target trajectory including a target path including a plurality of target points and time information that is information about a time for a movement of the specific portion along the target points, and a target trajectory correcting unit that corrects the target trajectory. The target trajectory correcting unit specifies at least one omission point from the plurality of target points according to a predetermined condition, and sets two points adjacent to both sides of the omission point as an omission start point and an omission end point, respectively, and sets a corrected target path that is a path from the omission start point to the omission end point so that the omission point for the specific portion is omitted from the plurality of target points on the target trajectory. Further, the target trajectory correcting unit sets the time information about the specific portion from the omission start point to the omission end point in the corrected target path based on at least one of a movement distance and a movement time of the specific portion from the omission start point to the omission end point on a pre-correction target trajectory.

In the above configuration, the target trajectory correcting unit may set the time information on the post-correction target trajectory so that a movement time of the specific portion from the omission start point to the omission end point in the corrected target path is equal to a movement time of the specific portion from the omission start point to the omission end point on the pre-correction target trajectory.

In the above configuration, the target trajectory correcting unit may set the post-correction target trajectory so that an average speed of the specific portion from the omission start point to the omission end point in the corrected target path is equal to an average speed of the specific portion from the omission start point to the omission end point on the pre-correction target trajectory.

In the above configuration, the work machine includes a bucket for excavation of soil as the attachment and further includes a bucket information detection unit that detects information about the bucket, and the target trajectory correcting unit sets the omission point based on a position of the specific portion at a time when at least one of a condition that the bucket information detection unit detects that a soil volume in the bucket exceeds a predetermined soil volume threshold and a condition that the bucket information detection unit detects that a load acting on the bucket exceeds a predetermined load threshold is satisfied.

The above configuration may further include a display unit that displays at least one of the corrected target path and the time information set by the target trajectory correcting unit.

The above configuration may further include a work machine including a machine body and an attachment that is attached to the machine body and performs work.

The invention claimed is:

1. A trajectory generating system that is used in a work machine including a machine body and an attachment that is attached to the machine body and performs work, and generates a trajectory of a specific portion of the attachment, the trajectory generating system comprising:

a target trajectory setting unit that sets a target trajectory including a target path including a plurality of target points and time information that is information about a time for a movement of the specific portion along the plurality of target points; and a target trajectory correcting unit that corrects the target trajectory, wherein the target trajectory correcting unit specifies at least one omission point from among the plurality of target points according to a predetermined condition, and sets two points adjacent to both sides of the omission point as an omission start point and an omission end point, respectively, sets a corrected target path that is a path from the omission start point to the omission end point so that the omission point for the specific portion is omitted from the plurality of target points on the target trajectory, and sets the time information about the specific portion from the omission start point to the omission end point in the corrected target path based on at least one of a movement distance and a movement time of the specific portion from the omission start point to the omission end point on a pre-correction target trajectory.

2. The trajectory generating system according to claim 1, wherein the target trajectory correcting unit sets the time information on a post-correction target trajectory so that a movement time of the specific portion from the omission start point to the omission end point in the corrected target path is equal to a movement time of the specific portion from the omission start point to the omission end point on the pre-correction target trajectory.

3. The trajectory generating system according to claim 1, wherein the target trajectory correcting unit sets the time information on a post-correction target trajectory so that an average speed of the specific portion from the omission start point to the omission end point in the corrected target path is equal to an average speed of the specific portion from the omission start point to the omission end point on the pre-correction target trajectory.

4. The trajectory generating system according to claim 1, wherein the work machine includes a bucket for excavation of soil as the attachment and further includes a bucket information detection unit that detects information about the bucket, and the target trajectory correcting unit sets the omission point based on a position of the specific portion at a time when at least one of a condition that the bucket information detection unit detects that a soil volume in the bucket exceeds a predetermined soil volume threshold and a condition that the bucket information detection unit detects that a load acting on the bucket exceeds a predetermined load threshold is satisfied.

5. The trajectory generating system according to claim 1, further comprising a display unit that displays at least one of the corrected target path and the time information set by the target trajectory correcting unit.

6. The trajectory generating system according to claim 1, further comprising a work machine including a machine body and an attachment that is attached to the machine body and performs work.

* * * * *